US011959677B2

(12) United States Patent
Yashiro et al.

(10) Patent No.: US 11,959,677 B2
(45) Date of Patent: Apr. 16, 2024

(54) REFRIGERATION APPARATUS HAVING INPUT OPERATION MODES

(71) Applicant: Mitsubishi Electric Corporation, Tokyo (JP)

(72) Inventors: Takanori Yashiro, Tokyo (JP); Hiroshi Sata, Tokyo (JP); Yusuke Arii, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 369 days.

(21) Appl. No.: 17/423,335

(22) PCT Filed: Apr. 9, 2019

(86) PCT No.: PCT/JP2019/015479
§ 371 (c)(1),
(2) Date: Jul. 15, 2021

(87) PCT Pub. No.: WO2020/208714
PCT Pub. Date: Oct. 15, 2020

(65) Prior Publication Data

US 2022/0120484 A1 Apr. 21, 2022

(51) Int. Cl.
*F25B 49/02* (2006.01)

(52) U.S. Cl.
CPC ..... *F25B 49/02* (2013.01); *F25B 2400/01* (2013.01); *F25B 2400/0409* (2013.01);
(Continued)

(58) Field of Classification Search
CPC .. F25B 49/02; F25B 2500/24; F25B 2600/05; F25B 2700/04
See application file for complete search history.

(56) References Cited

U.S. PATENT DOCUMENTS

2009/0025406 A1 1/2009 Yoshimi et al.
2018/0216859 A1* 8/2018 Gariety ..... F25B 49/02

FOREIGN PATENT DOCUMENTS

EP 3190355 A1 7/2017
EP 3193105 A2 7/2017
(Continued)

OTHER PUBLICATIONS

Extended European Search Report dated Feb. 21, 2022 issued in corresponding European Patent Application No. to 19924280.1.
(Continued)

*Primary Examiner* — Jonathan Bradford
(74) *Attorney, Agent, or Firm* — POSZ LAW GROUP, PLC

(57) ABSTRACT

A refrigeration apparatus includes: a refrigerant circuit through which refrigerant circulates; a controller to execute a plurality of refrigerant shortage sensing functions of sensing a shortage of an amount of the refrigerant; and an input device through which an operation mode to be set is input into the controller. The operation mode includes: a first mode in which energy-saving performance is emphasized; and a second mode in which the refrigeration apparatus is permitted to operate in a range in which reliability is ensured. In accordance with the operation mode set through the input device, the controller determines which one of sensing results obtained by the refrigerant shortage sensing functions is enabled and which one of sensing results obtained by the refrigerant shortage sensing functions is disabled. When a sensing result determined to be enabled shows a refrigerant shortage, the controller gives a notification about the refrigerant shortage.

8 Claims, 5 Drawing Sheets

(52) U.S. Cl.
CPC ..... *F25B 2400/0411* (2013.01); *F25B 2400/0417* (2013.01); *F25B 2500/222* (2013.01); *F25B 2500/24* (2013.01); *F25B 2600/05* (2013.01); *F25B 2600/2511* (2013.01); *F25B 2700/1931* (2013.01); *F25B 2700/1933* (2013.01); *F25B 2700/2101* (2013.01)

(56) References Cited

FOREIGN PATENT DOCUMENTS

| | | | |
|---|---|---|---|
| EP | 3348939 | A1 | 7/2018 |
| GB | 2564312 | A | 9/2019 |
| JP | 06-273013 | A | 9/1994 |
| JP | 2003-042655 | A | 2/2003 |
| JP | 2006-292213 | A | 10/2006 |
| JP | 2006-313057 | A | 11/2006 |
| JP | 5674452 | B | 2/2015 |
| WO | 2017/042649 | A1 | 3/2017 |

OTHER PUBLICATIONS

Office Action dated Aug. 29, 2022 issued in corresponding CN Patent Application No. 201980095142.1 (and English translation).
Office Action dated Jan. 19, 2023 issued in corresponding Chinese Patent Application No. 201980095142.1 (and English translation).
International Search Report of the International Searching Authority dated Jul. 2, 2019 for the corresponding International application No. PCT/JP2019/015479 (and English translation).

* cited by examiner

FIG.5

| CLASSIFICATION | SENSING LEVEL | SENSING METHOD |
|---|---|---|
| ENERGY SAVING | I | (1) SENSING OF LIQUID LEVEL IN LIQUID RESERVOIR |
| | II | (2) SENSING BY HEATING OF REFRIGERANT IN HIGH/ LOW PRESSURE INJECTION FLOW PATH |
| | III | (3) SENSING BASED ON TEMPERATURE EFFICIENCY |
| | IV | (4) SENSING BASED ON COMBINATION OF SC AMOUNT AND PARAMETERS SUCH AS CIRCULATING AMOUNT |
| | V | (5) SENSING BASED ON SC AMOUNT |
| RELIABILITY ENSURING | VI | (6) SENSING BASED ON DEGREE OF OPENING OF EXPANSION VALVE AT INTERMEDIATE INJECTION PORT |
| | VII | (7) SENSING BASED ON DEGREE OF OPENING OF EXPANSION VALVE IN MAIN LIQUID |
| | VIII | (8) SENSING BASED ON DECREASE IN LOW PRESSURE |
| | IX | (9) SENSING BASED ON ABNORMALITY OF TEMPERATURE AT DISCHARGE PORT |

FIG.6

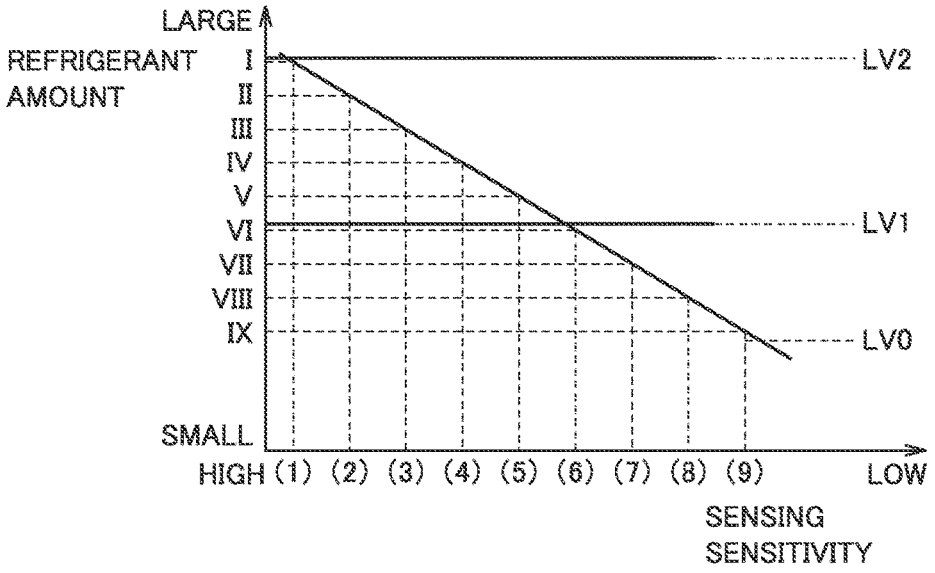

REFRIGERATION APPARATUS HAVING INPUT OPERATION MODES

CROSS REFERENCE TO RELATED APPLICATION

This application is a U.S. national stage application of International Patent Application No. PCT/JP2019/015479 filed on Apr. 9, 2019, the disclosure of which is incorporated herein by reference.

TECHNICAL FIELD

The present disclosure relates to a refrigeration apparatus.

BACKGROUND

Japanese Patent Laying-Open No. 6-273013 (PTL 1) discloses a refrigeration cycle apparatus in which a refrigerant leakage is detected at the earliest possible time point to thereby improve reliability.

PATENT LITERATURE

PTL 1: Japanese Patent Laying-Open No. 6-273013

In recent years, studies have been conducted to achieve a method of detecting a refrigerant leakage more accurately and at an earlier stage as compared with the method disclosed in Japanese Patent Laying-Open No. 6-273013 (PTL 1). Further, studies have also been conducted to achieve a refrigeration apparatus implementing a plurality of refrigerant shortage sensing methods so as to allow reliable sensing of a refrigerant leakage.

When a plurality of refrigerant shortage sensing methods are implemented by a refrigeration apparatus, it is conceivable to determine the refrigerant shortage state based on each of the methods. However, these refrigerant shortage sensing methods determine a shortage of the refrigerant amount based on various degrees of strictness. When a refrigeration apparatus implementing a plurality of refrigerant shortage sensing methods performs all of the refrigerant shortage sensing methods irrespective of the user's desire, abnormality notifications not desired by some users may be issued, which may be annoying for these users.

SUMMARY

An object of the present invention is to provide a refrigeration apparatus by which a refrigerant shortage sensing method appropriate to a refrigerant amount suitable to achieve the performance desired by a user is performed.

The present disclosure relates to a refrigeration apparatus that performs cooling using refrigerant. The refrigeration apparatus includes: a refrigerant circuit through which the refrigerant circulates; a controller to perform refrigerant shortage sensing functions of sensing a shortage of an amount of the refrigerant; and an input device through which an operation mode to be set is input into the controller. The operation mode includes: a first mode in which energy-saving performance is emphasized; and a second mode in which the refrigeration apparatus is permitted to operate in a range in which reliability is ensured. In accordance with the operation mode set through the input device, the controller determines which one of sensing results obtained by the refrigerant shortage sensing functions is to be enabled and which one of sensing results obtained by the refrigerant shortage sensing functions is to be disabled. When a sensing result determined to be enabled shows a refrigerant shortage, the controller gives a notification about the refrigerant shortage.

According to the refrigeration apparatus of the present disclosure, the refrigeration apparatus configured to be capable of performing a plurality of refrigerant shortage sensing methods can enable a refrigerant shortage sensing method appropriate to a refrigerant amount suitable to achieve the performance desired by a user, and therefore, a refrigerant shortage warning not desired by the user can be avoided.

BRIEF DESCRIPTION OF DRAWINGS

FIG. 5 is a diagram showing a list of refrigerant shortage sensing methods (1) to (9), each of which can be performed in the second embodiment.

FIG. 6 is a diagram showing the relation between a refrigerant amount and the sensing methods (1) to (9).

DETAILED DESCRIPTION

Figure 1:
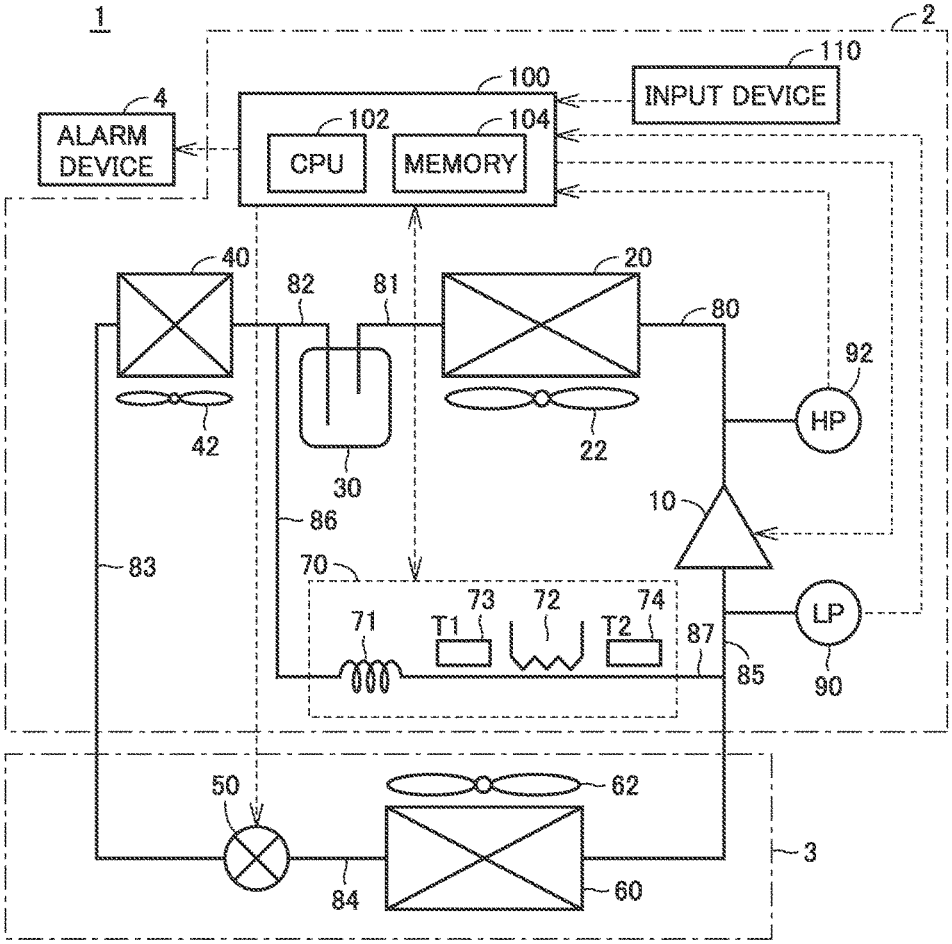
FIG. 1 is an overall configuration diagram of a refrigeration apparatus according to a first embodiment of the present disclosure.

Hereinafter, embodiments of the present invention will be described in detail with reference to the accompanying drawings. While a plurality of embodiments will be described below, it has been originally intended at the time of filing of the present application to appropriately combine the configurations described in the embodiments. In the accompanying drawings, the same or corresponding portions are denoted by the same reference characters, and the description thereof will not be repeated.

First Embodiment

FIG. 1 is an overall configuration diagram of a refrigeration apparatus according to a first embodiment of the present disclosure. It should be noted that FIG. 1 functionally shows the connection relation and the arrangement configuration of devices in the refrigeration apparatus, but does not necessarily show the arrangement in a physical space.

Referring to FIG. 1, a refrigeration apparatus 1 includes an outdoor unit 2 and an indoor unit 3. Outdoor unit 2 includes a compressor 10, a condenser 20, a fan 22, a liquid reservoir 30, a heat exchanger 40, a fan 42, and pipes 80 to 83 and 85. Outdoor unit 2 further includes pipes 86 and 87, a refrigerant amount detector 70, pressure sensors 90 and 92, a controller 100, and an input device 110. Indoor unit 3 includes an expansion valve 50, an evaporator 60, a fan 62, and a pipe 84. Indoor unit 3 is connected to outdoor unit 2 through pipes 83 and 85.

Pipe 80 connects a discharge port of compressor 10 and condenser 20. Pipe 81 connects condenser 20 and liquid reservoir 30. Pipe 82 connects liquid reservoir 30 and heat exchanger 40. Pipe 83 connects heat exchanger 40 and expansion valve 50. Pipe 84 connects expansion valve 50 and evaporator 60. Pipe 85 connects evaporator 60 and a suction port of compressor 10. Pipe 86 connects pipe 82 and refrigerant amount detector 70. Pipe 87 connects refrigerant amount detector 70 and pipe 85.

Compressor 10 compresses the refrigerant suctioned from pipe 85 and outputs the compressed refrigerant to pipe 80. Compressor 10 is configured to adjust the rotation speed according to a control signal from controller 100. By adjusting the rotation speed of compressor 10, the amount of the circulating refrigerant is adjusted, and thus, the performance of refrigeration apparatus 1 can be adjusted. Compressor may be of various types such as a scroll type, a rotary type, and a screw type, for example.

Condenser 20 condenses the refrigerant output from compressor 10 to pipe 80 and outputs the condensed refrigerant to pipe 81. Condenser 20 is configured such that the high-temperature and high-pressure gas refrigerant output from compressor 10 exchanges heat with the outside air (radiates heat). By this heat exchange, the refrigerant is condensed and turns into a liquid phase. Fan 22 supplies outside air to condenser 20 in which the refrigerant exchanges heat with this outside air. By adjusting the rotation speed of fan 22, the refrigerant pressure on the discharge side of compressor 10 (the pressure on the high-pressure side) can be adjusted.

Liquid reservoir 30 stores the high-pressure liquid refrigerant condensed by condenser 20. Heat exchanger 40 is configured such that the liquid refrigerant output from liquid reservoir 30 to pipe 82 further exchanges heat with the outside air (radiates heat). The refrigerant flows through heat exchanger 40 and thereby turns into supercooled liquid refrigerant. Fan 42 supplies outside air to heat exchanger 40 in which the refrigerant exchanges heat with this outside air.

Expansion valve 50 decompresses the refrigerant output from heat exchanger 40 to pipe 83 and outputs the decompressed refrigerant to pipe 84. When controller 100 changes the degree of opening of expansion valve 50 in a closing direction, the refrigerant pressure on the downstream side of expansion valve 50 decreases, and the degree of dryness of the refrigerant increases. When controller 100 changes the degree of opening of expansion valve 50 in an opening direction, the refrigerant pressure on the downstream side of expansion valve 50 increases, and the degree of dryness of the refrigerant decreases.

Evaporator 60 evaporates the refrigerant output from expansion valve 50 to pipe 84 and outputs the evaporated refrigerant to pipe 85. Evaporator 60 is configured such that the refrigerant decompressed by expansion valve 50 exchanges heat with the air inside indoor unit 3 (absorbs heat). The refrigerant having flowed through evaporator 60 evaporates and turns into superheated vapor. Fan 62 supplies outside air to evaporator 60 in which the refrigerant exchanges heat with this outside air.

Refrigerant amount detector 70 is provided between pipe 86 branched off from pipe 82 and pipe 87 connected to pipe 85. Pipe 86, refrigerant amount detector 70, and pipe 87 constitute a "bypass circuit" through which a part of the refrigerant on the downstream side of condenser 20 is returned to compressor 10 without passing through indoor unit 3.

Refrigerant amount detector 70 includes a capillary tube 71, a heater 72, and temperature sensors 73 and 74. The refrigerant in liquid reservoir 30 is in a two-phase state of a gas phase and a liquid phase, and the pressure in liquid reservoir 30 is saturated vapor pressure. The liquid refrigerant at the saturated vapor pressure flows into pipe 86. Capillary tube 71 is connected between pipes 86 and 87, and lowers the pressure of the refrigerant flowing through pipe 86 of the bypass circuit. Capillary tube 71 is designed as appropriate also in consideration of the amount of heat by heater 72 such that, when liquid refrigerant is supplied through pipe 86, the refrigerant having passed through capillary tube 71 remains in a gas-liquid two-phase state without turning into a gas single-phase state even when the refrigerant is heated by heater 72. It should be noted that an expansion valve may be used in place of capillary tube 71.

Heater 72 and temperature sensors 73 and 74 are provided in pipe 87. Heater 72 heats the refrigerant having passed through capillary tube 71. The refrigerant having passed through capillary tube 71 is heated by heater 72, and thereby, increased in enthalpy. As described above, the amount of heat by heater 72 is set in conjunction with the specifications of capillary tube 71 such that the refrigerant having passed through capillary tube 71 remains in a gas-liquid two-phase state without turning into a gas single-phase state even when the refrigerant is heated by heater 72. Heater 72 may heat the refrigerant from the outside of pipe 87, or may be installed inside pipe 87 so as to allow more reliable transfer of heat from heater 72 to the refrigerant.

Temperature sensor 73 detects the temperature of the refrigerant before being heated by heater 72, i.e., a temperature T1 of the refrigerant between capillary tube 71 and heater 72, and then, outputs the detection value to controller 100. On the other hand, temperature sensor 74 detects the temperature of the refrigerant after being heated by heater 72, i.e., a temperature T2 of the refrigerant downstream from heater 72 and before being joined into pipe 85, and then, outputs the detection value to controller 100. Temperature sensors 73 and 74 may be installed outside pipe 87, or may be installed inside pipe 87 so as to more reliably detect the temperature of the refrigerant. The principle and method of sensing a refrigerant shortage by refrigerant amount detector 70 will be described later in detail.

Pressure sensor 90 detects pressure LP of the refrigerant in pipe 85, and outputs the detection value to controller 100. In other words, pressure sensor 90 serves to detect the refrigerant pressure on the suction side (the pressure on the low-pressure side) of compressor 10. Pressure sensor 92 detects pressure HP of the refrigerant inside pipe 80, and outputs the detection value to controller 100. In other words, pressure sensor 92 serves to detect the refrigerant pressure on the discharge side (the pressure on the high-pressure side) of compressor 10.

Controller 100 is configured to include a central processing unit (CPU) 102, a memory 104 (a read only memory (ROM) and a random access memory (RAM)), an input/output buffer (not shown) through which various signals are input and output, and the like. CPU 102 deploys programs stored in the ROM into the RAM or the like and executes the programs. The programs stored in the ROM describe a processing procedure of controller 100. Controller 100 controls each of devices in outdoor unit 2 according to these programs. This control is not limited to processing by software, but can also be processed by dedicated hardware (an electronic circuit).

<Description of Sensing of Refrigerant Shortage>

Hereinafter, the first sensing method of sensing a refrigerant shortage using refrigerant amount detector 70 will be described. A refrigerant shortage occurs when the amount of refrigerant initially fed into the refrigerant circuit is insufficient, or when the refrigerant leaks after the start of use.

Figure 2:
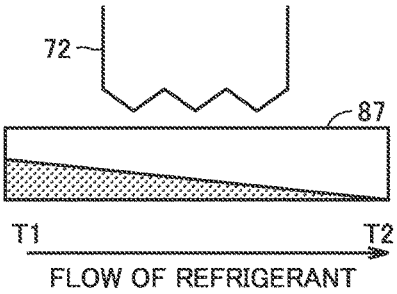
FIG. 2 is a diagram conceptually showing the state of refrigerant around a heater 72 in a normal state in which a refrigerant shortage does not occur.

FIG. 2 is a diagram conceptually showing the state of refrigerant around heater 72 in a normal state in which a refrigerant shortage does not occur. In the following description, the state where a refrigerant shortage does not occur and the amount of refrigerant is within an appropriate range may be simply referred to as a "normal state".

Referring to FIGS. 1 and 2, in the normal state where the refrigerant amount is appropriate, the refrigerant is substantially in a liquid-phase state at the outlet of condenser 20, and the liquid refrigerant is accumulated in liquid reservoir 30. Thus, the liquid refrigerant flows through pipe 86, and the refrigerant having passed through capillary tube 71 contains a liquid component in a large amount. The refrigerant having passed through capillary tube 71 is heated by heater 72, and thus, the degree of dryness of the refrigerant rises.

In the case where the refrigerant is azeotropic refrigerant (refrigerant having no temperature gradient, for example, refrigerant such as R410a), in a normal state, the refrigerant having passed through capillary tube 71 is in a two-phase state in which the refrigerant contains a liquid component in a large amount. Accordingly, even when the refrigerant is heated by heater 72, the temperature of the refrigerant basically does not change (heating energy is utilized to change the latent heat of the refrigerant). Thus, temperature T2 of the refrigerant after being heated by heater 72 is substantially equal to temperature T1 of the refrigerant before being heated by heater 72.

Although not particularly shown, in the case where the refrigerant is non-azeotropic refrigerant (refrigerant having a temperature gradient, for example, refrigerant such as R407a, R448a, R449a, and R463a), the temperature of the refrigerant rise to some extent (by about 10° C.) by heating with heater 72.

On the other hand, when a refrigerant shortage occurs, the refrigerant is in a gas-liquid two-phase state at the outlet of condenser 20, and no liquid refrigerant or a small amount of liquid refrigerant, if any, is accumulated in liquid reservoir 30. Thus, the refrigerant in a gas-liquid two-phase state flows through pipe 86, and the refrigerant having passed through capillary tube 71 contains a gas component in an amount larger than that in the normal state. Accordingly, in the case where a refrigerant shortage occurs, when the refrigerant having passed through capillary tube 71 is heated by heater 72, the refrigerant in pipe 87 evaporates midway through pipe 87 and entirely turns into a gaseous state, with the result that the temperature of the refrigerant rises (the degree of superheat >0), unlike FIG. 2. Therefore, temperature T2 of the refrigerant after being heated by heater 72 is higher than temperature T1 of the refrigerant before being heated by heater 72.

In the case where the refrigerant is non-azeotropic refrigerant, the amount of heat by heater 72 is set as appropriate such that the temperature rise in the refrigerant by heater 72 during a refrigerant shortage can be distinguished from the temperature rise in the refrigerant by heater 72 in the normal state (the temperature rise based on the temperature gradient of the refrigerant).

In this way, based on the range in which the temperature of the refrigerant rises due to heating by heater 72, refrigerant amount detector 70 can detect whether a refrigerant shortage occurs or not in refrigeration apparatus 1.

Then, the second sensing method of sensing a refrigerant shortage will be described. According to the second sensing method, based on the degree of opening of expansion valve 50, controller 100 determines whether a refrigerant shortage occurs or not. The upper limit is set for the degree of opening of expansion valve 50 in the product development stage. When a refrigerant shortage occurs, and when the pressure (low pressure) in pipe 85 does not rise to a target value even if the degree of opening of expansion valve 50 is fully opened, then, this fully opened state is kept for a time period equal to or longer than a prescribed time period. Thus, when the time period during which the degree of opening of expansion valve 50 exceeds the design upper limit degree of opening continues for a time period equal to or longer than a prescribed time period, controller 100 determines that a refrigerant shortage occurs.

The first sensing method using refrigerant amount detector 70 as described above can detect even a slight decrease of the refrigerant amount more sensitively than by the second sensing method of making determinations based on the degree of opening of expansion valve 50.

Therefore, the first sensing method is preferable as a method of determining a shortage of the refrigerant amount required for refrigeration apparatus 1 to operate with excellent efficiency and with less energy loss. On the other hand, the second sensing method is preferable as a method of preventing failures from occurring in refrigeration apparatus 1 due to an overload of compressor 10 or the like, i.e., a method of determining a shortage of the refrigerant amount required to ensure the reliability of refrigeration apparatus 1.

Figure 3:
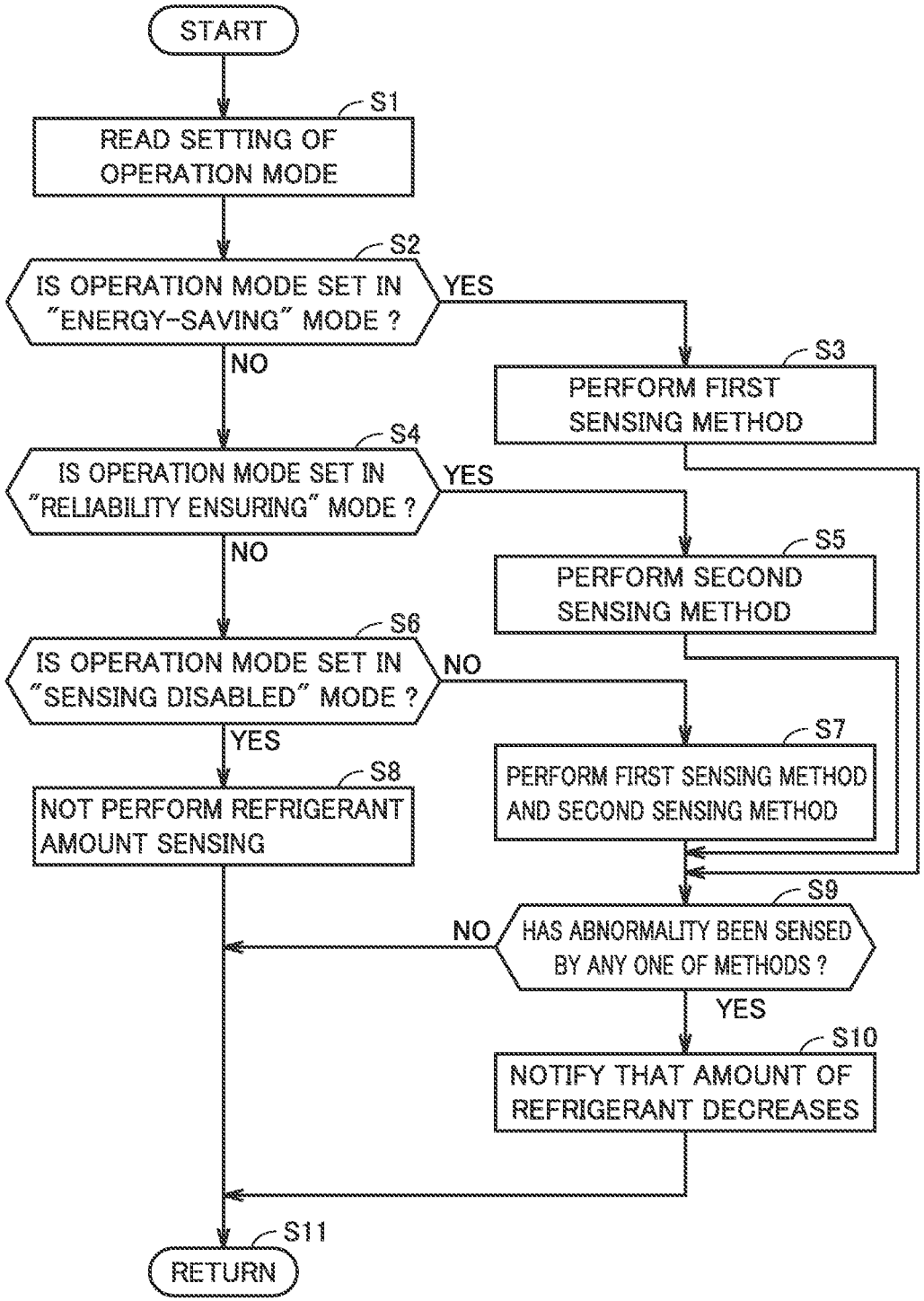
FIG. 3 is a flowchart for explaining a process of refrigerant shortage sensing control in the refrigeration apparatus according to the first embodiment.

FIG. 3 is a flowchart for explaining a process of refrigerant shortage sensing control in the refrigeration apparatus according to the first embodiment. The process in this flowchart is called from a main routine of the control of the refrigeration apparatus and executed every time a prescribed time period elapses or every time a predetermined condition is satisfied. Referring to FIGS. 1 and 3, controller 100 first reads the setting of an operation mode in step S1. The operation mode is set in advance by a user through input device 110. Examples of the operation mode conceivable in this case include: an "energy-saving" mode in which a refrigerant shortage is sensed before the performance decreases; a "reliability ensuring" mode in which a refrigerant shortage is not sensed unless there is a refrigerant shortage that causes an uncooled state (the internal temperature does not reach a target value) or unless there is a refrigerant shortage that influences a failure in the compressor, even if the performance decreases to some extent and the energy-saving performance decreases; a "sensing disabled" mode in which refrigerant shortage sensing is not performed; and the like. The operation mode is set in a "normal" mode unless it is designated by the user.

After step S2 and subsequent steps, controller 100 selects a refrigerant shortage sensing method in accordance with the operation mode set by the user. In step S2, controller 100 determines whether the operation mode is set in an "energy-saving" mode or not. When the operation mode is set in an "energy-saving" mode (YES in S2), controller 100 controls compressor 10 and the like in accordance with the "energy-saving" mode. In step S3, for sensing a refrigerant shortage, controller 100 performs the above-mentioned first sensing method performed using refrigerant amount detector 70.

On the other hand, when the operation mode is not set in an "energy-saving" mode (NO in S2), then in step S4, controller 100 determines whether the operation mode is set in a "reliability ensuring" mode or not. When the operation mode is set in a "reliability ensuring" mode (YES in S4), controller 100 controls compressor 10 in accordance with the "reliability ensuring" mode. In step S5, controller 100 performs the above-mentioned second sensing method by which a refrigerant shortage is determined based on the degree of opening of expansion valve 50.

On the other hand, when the operation mode is not set in a "reliability ensuring" mode (NO in S4), then in step S6, controller 100 determines whether the operation mode is set in a "sensing disabled" mode or not. When the operation mode is not set in a "sensing disabled" mode (NO in S6), controller 100 controls compressor 10 in accordance with the "normal" mode adopted unless otherwise designated. Then, in step S7, controller 100 performs the above-mentioned first and second sensing methods for sensing a refrigerant shortage.

On the other hand, when the operation mode is set in a "sensing disabled" mode (YES in S6), controller 100 proceeds to step S8, and does not perform refrigerant amount sensing.

On the other hand, when the refrigerant shortage sensing method is performed in one of steps S3, S5, and S7, controller 100 determines in step S9 whether an abnormality has been sensed or not, i.e., whether a refrigerant shortage has been sensed or not, in any one of the methods. When an abnormality has been sensed (YES in S9), then in step S10, controller 100 activates an alarm device 4 to notify the user that the amount of refrigerant decreases. For example, as alarm device 4, a buzzer or a patrol lamp is attached to a contact output provided in outdoor unit 2. Further, for issuing an alarm, an indication showing an abnormality may be displayed on a screen of a remote controller or a system controller through serial communication, LAN communication, or the like.

The type of alarm in step S10 may be selected so as to show which sensing method is employed to sense an abnormality. For example, in the case where a plurality of contacts are provided at which controller 100 is connected to alarm device 4, the patrol lamp and the like can be controlled such that a yellow lamp is turned on in the case of the first sensing method (the refrigerant decreases in a relatively small amount), and a red lamp is turned on in the case of the second sensing method (the refrigerant decreases in a relatively large amount). Alternatively, in the case of the first sensing method (the refrigerant decreases in a relatively small amount), an alarm may be shown by alarm device 4 at the site where refrigerant apparatus 1 is placed. Also, in the case of the second sensing method (the refrigerant decreases in a relatively large amount), based on the determination that a failure occurs in a unit, alarm device 4 may be activated and a user in a remote place may be notified about an abnormality through communication.

Referring again to FIG. 1, refrigeration apparatus 1 according to the first embodiment includes: a refrigerant circuit through which refrigerant circulates, controller 100 that performs a plurality of refrigerant shortage sensing functions of sensing a shortage of the amount of refrigerant; and input device 110 through which an operation mode to be set is input into controller 100. The operation mode includes: a first mode (an "energy-saving" mode) in which a refrigerant shortage is sensed when the amount of refrigerant decreases below a determination value that is set with an emphasis placed on the energy-saving performance; and a second mode (a "reliability ensuring" mode) in which a refrigerant shortage sensing is performed only after the amount of refrigerant further decreases below the determination value in the first mode and falls within a range of an uncooled state or a range in which the reliability of the refrigeration apparatus is not ensured. In accordance with the operation mode set through input device 110, controller 100 determines which one of sensing results obtained by the plurality of refrigerant shortage sensing functions is enabled and which one of sensing results obtained by the plurality of refrigerant shortage sensing functions is disabled. Then, when the sensing result determined to be enabled shows a refrigerant shortage, controller 100 gives a notification about the refrigerant shortage.

As described above, when the user sets the operation mode so as to allow refrigeration apparatus 1 to achieve the performance desired by the user, refrigeration apparatus 1 according to the first embodiment automatically enables the refrigerant shortage sensing method appropriate to the refrigerant amount suitable to achieve the performance desired by the user. Therefore, a refrigerant shortage warning not desired by the user can be avoided from being issued without the user's intention.

Second Embodiment

Figure 4:
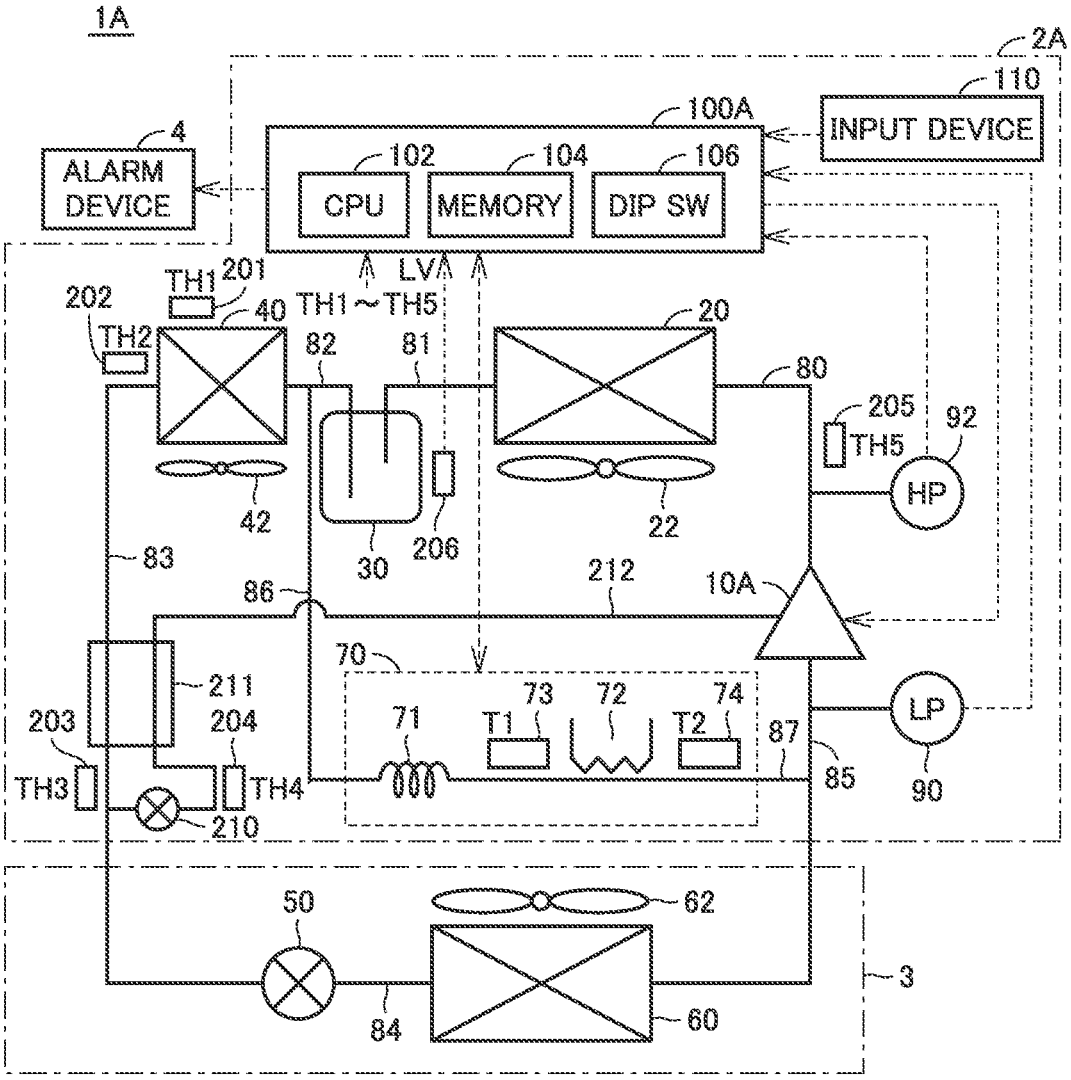
FIG. 4 is an overall configuration diagram of a refrigeration apparatus according to a second embodiment of the present disclosure.

FIG. 4 is an overall configuration diagram of a refrigeration apparatus according to the second embodiment of the present disclosure. It should be noted that FIG. 4 functionally shows the connection relation and the arrangement configuration of devices in the refrigeration apparatus, but does not necessarily show the arrangement in a physical space.

Referring to FIG. 4, a refrigeration apparatus 1A includes an outdoor unit 2A and an indoor unit 3. Since indoor unit 3 has the same configuration as that in FIG. 1, the description thereof will not be repeated. Outdoor unit 2A has the same configuration as that of outdoor unit 2 shown in FIG. 1 except that it includes a controller 100A in place of controller 100 and a compressor 10A in place of compressor 10. Outdoor unit 2A further includes an internal heat exchanger 211, an expansion valve 210, a pipe 212, temperature sensors 201 to 205, and a liquid level sensor 206.

Compressor 10A includes an intermediate pressure injection port in addition to a suction port and a discharge port.

Pipe 212 branches off from pipe 83 and supplies the refrigerant decompressed by expansion valve 210 to the intermediate pressure injection port of compressor 10A.

Internal heat exchanger 211 exchanges heat between the refrigerant flowing through pipe 83 and the refrigerant flowing through pipe 212. Thus, even when the refrigerant flowing through pipe 83 turns into a gas-liquid mixed state, the refrigerant having reached expansion valve 50 is cooled, and the refrigerant on the upstream side of expansion valve 50 is brought into a liquid-phase state.

Temperature sensor 201 senses a temperature TH1 on the cooling side of heat exchanger 40 serving as a supercooler, i.e., senses the temperature of air taken from the outside in the case of an air-heat exchanger. Temperature sensor 202 senses a temperature TH2 on the cooled side of heat exchanger 40 serving as a supercooler, i.e., senses the temperature of the liquid refrigerant in the case of an air-heat exchanger.

Temperature sensor 204 senses a temperature TH4 on the cooling side of internal heat exchanger 211 serving as a supercooler, i.e., senses the temperature of the refrigerant having passed through expansion valve 210. Temperature sensor 203 senses a temperature TH3 on the cooled side of internal heat exchanger 211 serving as a supercooler, i.e., senses the temperature of the liquid refrigerant at the outlet of pipe 83.

Temperature sensor 205 senses a refrigerant temperature TH5 discharged from compressor 10A. Liquid level sensor 206 detects the liquid level of the liquid refrigerant stored in liquid reservoir 30.

Refrigeration apparatus 1A according to the second embodiment that additionally includes the above-mentioned sensors can perform a greater variety of methods for sensing a refrigerant shortage.

In addition to CPU 102 and memory 104, controller 100A further includes a DIP switch 106 that designates each of the refrigerant shortage sensing methods performed in the second embodiment to be enabled or disabled.

Since other configurations of outdoor unit 2A are the same as those of outdoor unit 2 shown in FIG. 1, the description thereof will not be repeated.

FIG. 5 is a diagram showing a list of refrigerant shortage sensing methods (1) to (9), each of which can be performed in the second embodiment. FIG. 6 is a diagram showing the relation between the refrigerant amount and the sensing methods (1) to (9).

Referring to FIGS. 5 and 6, the amount of refrigerant sensed as a refrigerant shortage by each of the sensing methods (1) to (9) is defined as a corresponding one of sensing levels I to IX. In other words, the sensing method (1) is to sense that a refrigerant shortage occurs when the refrigerant amount decreases even only slightly below a refrigerant amount LV2 required to achieve the highest energy-saving performance. In other words, the sensing method (1) is highly sensitive to a refrigerant shortage. In contrast, the sensing method (9) is to sense that a refrigerant shortage occurs when the refrigerant amount decreases to a refrigerant amount XI close to a refrigerant amount LV0 at which a refrigerant shortage causes a failure in compressor 10A.

In other words, it is recognized that the sensitivity to the decrease in the refrigerant amount is higher in order of the sensing methods (1) to (9).

The sensing method (1) is to detect the liquid level by liquid level sensor 206 provided in liquid reservoir 30 in a steady state during operation. When the liquid level is equivalent to a level of a refrigerant shortage, controller 100A activates alarm device 4.

The sensing method (2) is to determine whether a refrigerant shortage occurs or not, based on the difference between temperatures (T2−T1) at positions ahead of and behind heater 72 in the pipe located behind capillary tube 71 in pipe 87 that extends from pipe 82 connected to the outlet of liquid reservoir 30 toward the suction port of compressor 10A. This method corresponds to the first sensing method in the first embodiment.

The sensing method (3) is to give a warning about a refrigerant shortage when temperature efficiency $\varepsilon=(Tc-TH2)/(Tc-TH1)$ or when $(Tc-TH3)/(Tc-TH4)$ is equal to or less than the determination value. In this case, temperatures TH1 to TH4 are sensed by respective temperature sensors 201 to 204 in FIG. 4. A temperature Tc is a saturation temperature of the refrigerant equivalent to high pressure.

The sensing method (4) is to determine whether a refrigerant shortage occurs or not, based on a combination of: the degree of supercooling SC=Tc−TH2 at the outlet of heat exchanger 40 serving as a supercooler or the degree of supercooling SC=Tc−TH3 at the outlet of heat exchanger 211; and parameters such as the outside air temperature and the amount of the circulating refrigerant (calculated from the values detected by thermistors, pressure sensors and the like, or directly measured).

The sensing method (5) is to give a warning that a refrigerant shortage occurs when the degree of supercooling SC=Tc−TH2 at the outlet of heat exchanger 40 serving as a supercooler or the degree of supercooling SC=Tc−TH3 at the outlet of heat exchanger 211 is smaller than the determination value.

The sensing method (6) is to determine that a refrigerant shortage occurs when expansion valve 210 provided in pipe 212 connected to the intermediate pressure injection port of compressor 10A is kept opened at a degree of opening equal to or greater than a prescribed degree of opening (or kept opened at the maximum degree of opening) for a prescribed time period.

The sensing method (7) is to determine that a refrigerant shortage occurs when expansion valve 50 is kept opened at a degree of opening equal to or greater than a prescribed degree of opening (or kept opened at the maximum degree of opening) for a prescribed time period.

The sensing method (8) is to determine that a refrigerant shortage occurs when the detection value of pressure sensor 90 that detects the pressure of a low pressure portion becomes equal to or less than (becomes less than) prescribed pressure.

The sensing method (9) is to determine that a refrigerant shortage occurs, based on the determination that a refrigerant shortage may consequently influence the sensing result that the detection value of temperature sensor 205 at the discharge portion of compressor 10A is equal to or higher than a prescribed temperature or is higher than a prescribed temperature.

Refrigeration apparatus 1A according to the second embodiment is configured to be capable of performing the above-described sensing methods (1) to (9). However, some users may demand not to issue an alarm in response to indiscriminate sensing but to issue an alarm only when refrigerant becomes insufficient to such an extent as increasing the possibility of failures.

Further, it is also difficult for the user to select an appropriate sensing method that meets the user's needs from among the above-mentioned plurality of sensing methods.

Thus, in refrigeration apparatus 1A according to the second embodiment, when an operation mode such as an "energy-saving" mode or a "reliability ensuring" mode is designated, an appropriate refrigerant shortage sensing method is selected in accordance with the designated operation mode. Also, by further providing DIP switch 106 in controller 100A, the user can disable each of the refrigerant shortage sensing methods. Accordingly, an alarm suitable to the refrigerant amount required to maintain the performance desired by the user can be implemented.

Figure 7:
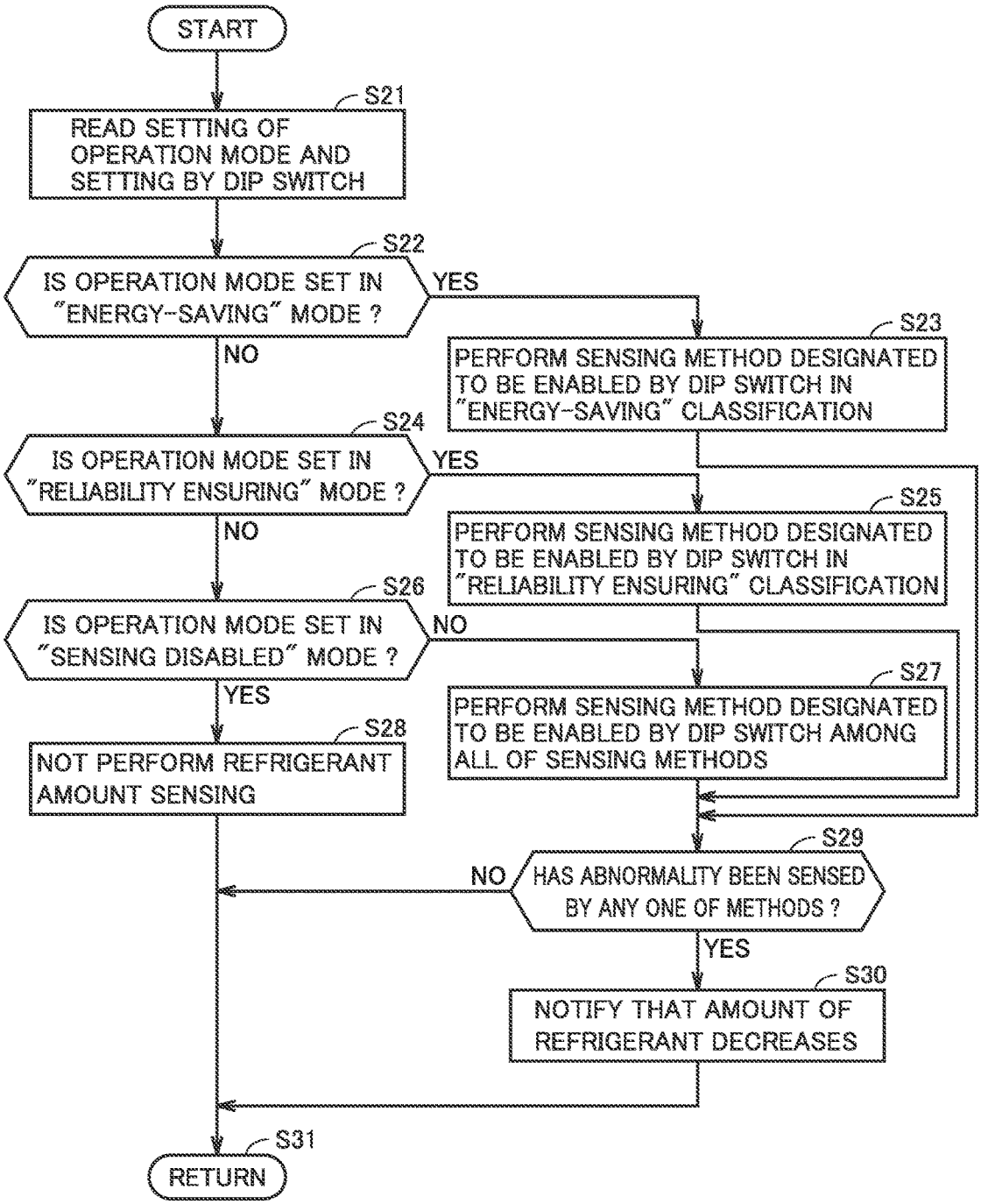
FIG. 7 is a flowchart for explaining a process of refrigerant shortage sensing control in the refrigeration apparatus according to the second embodiment.

FIG. 7 is a flowchart for explaining a process of refrigerant shortage sensing control in the refrigeration apparatus according to the second embodiment. The process in this flowchart is called from a main routine of the control of the refrigeration apparatus and executed every time a prescribed time period elapses or every time a predetermined condition is satisfied. Referring to FIGS. 4 and 7, controller 100A first reads the setting of the operation mode and the setting by DIP switch 106 in step S21. The operation mode is set in advance by a user through input device 110. Examples of the operation mode conceivable in this case include: an "energy-saving" mode in which power consumption is suppressed as low as possible; a "reliability ensuring" mode in which the operation is permitted within a range in which the reliability of each device is ensured even if power consumption increases to some extent; a "sensing disabled" mode in which refrigerant shortage sensing is not performed; and the like. The operation mode is set in a "normal" mode unless it is designated by the user.

DIP switch 106 is provided on a control board of controller 100A and configured such that the user can set each of the sensing methods (1) to (9) to be enabled or disabled.

In step S22 and subsequent steps, controller 100A selects a refrigerant shortage sensing method in accordance with the operation mode set by the user. In step S22, controller 100A determines whether the operation mode is set in an "energy-saving" mode or not. When the operation mode is set in an "energy-saving" mode (YES in S22), controller 100A controls compressor 10A and the like in accordance with the "energy-saving" mode. In step S23, for sensing a refrigerant shortage, controller 100A performs the sensing method designated to be enabled by DIP switch 106 among the sensing methods (1) to (5) in the "energy-saving" classification shown in FIG. 5.

On the other hand, when the operation mode is not set in an "energy-saving" mode (NO in S22), then in step S24, controller 100A determines whether the operation mode is set in a "reliability ensuring" mode or not. When the operation mode is set in a "reliability ensuring" mode (YES in S24), controller 100A controls compressor 10A in accordance with the "reliability ensuring" mode. In step S25, for sensing a refrigerant shortage, controller 100A performs the sensing method designated to be enabled by DIP switch 106 among the sensing methods (6) to (9) in the "reliability ensuring" classification shown in FIG. 5.

On the other hand, when the operation mode is not set in a "reliability ensuring" mode (NO in S24), then in step S26, controller 100A determines whether the operation mode is set in a "sensing disabled" mode or not. When the operation mode is not set in a "sensing disabled" mode (NO in S26), controller 100A controls compressor 10A in accordance with the "normal" mode adopted unless otherwise designated. Then, in step S27, for sensing a refrigerant shortage, controller 100A performs the sensing method designated to be enabled by DIP switch 106 among all of the sensing methods (1) to (9).

On the other hand, when the operation mode is set in a "sensing disabled" mode (YES in S26), controller 100A proceeds to step S28 and does not perform refrigerant amount sensing.

On the other hand, when the refrigerant shortage sensing method is performed in one of steps S23, S25, and S27, controller 100A determines in step S29 whether an abnormality has been sensed or not, i.e., whether a refrigerant shortage has been sensed or not, in any one of the methods. When an abnormality has been sensed (YES in S29), then in step S30, controller 100A activates an alarm device 4 to notify the user that the amount of refrigerant decreases. For example, as alarm device 4, a buzzer or a patrol lamp is attached to a contact output provided in outdoor unit 2A. Further, for issuing an alarm, an indication showing an abnormality may be displayed on a screen of a remote controller or a system controller through serial communication, LAN communication, or the like.

The type of an alarm in step S30 may be selected so as to show which sensing method is employed to sense an abnormality. For example, in the case where a plurality of contacts are provided at which controller 100A is connected to alarm device 4, the patrol lamp and the like can be controlled such that a yellow lamp is turned on in the case of the sensing method classified as "energy-saving" (the refrigerant decreases in a relatively small amount), and a red lamp is turned on in the case of the sensing method classified as "reliability ensuring" (the refrigerant decreases in a relatively large amount). Alternatively, in the case of the sensing method classified as "energy saving" (the refrigerant decreases in a relatively small amount), an alarm may be shown by alarm device 4 at the site where refrigerant apparatus 1 is placed. Also, in the case of the sensing method classified as "reliability ensuring" (the refrigerant decreases in a relatively large amount), based on the determination that a failure may occur in a unit, alarm device 4 may be activated and a user in a remote place may be notified about an abnormality through communication.

Referring again to FIG. 4, refrigeration apparatus 1A includes: a refrigerant circuit through which refrigerant circulates; controller 100A that executes a plurality of refrigerant shortage sensing functions of sensing a shortage of the amount of refrigerant; and input device 110 through which an operation mode to be set is input into controller 100A. The operation mode includes: a first mode in which a refrigerant shortage is sensed when the amount of the refrigerant decreases below a determination value that is set with an emphasis placed on the energy-saving performance; and a second mode in which refrigerant shortage sensing is performed only after the amount of the refrigerant further decreases below the determination value in the first mode and falls within a range of an uncooled state or a range in which the reliability of the refrigeration apparatus is not ensured. In accordance with the operation mode set through input device 110A, controller 100A determines which one of sensing results obtained by the refrigerant shortage sensing functions is enabled and which one of sensing results obtained by the refrigerant shortage sensing functions is disabled. Then, when the sensing result determined to be enabled shows a refrigerant shortage, controller 100A gives a notification about the refrigerant shortage.

When the operation mode is set, a refrigerant shortage sensing method suitable to the set operation mode is automatically selected. Accordingly, a refrigerant shortage warning not desired by the user can be avoided.

Preferably, in the second embodiment, the plurality of refrigerant shortage sensing methods are divided into a first group classified as "energy saving" and a second group classified as "reliability ensuring", as shown in FIG. 5. As shown in the flowchart in FIG. 7, controller 100A is configured to be capable of selecting at least an "energy-saving" mode as the first setting and a "reliability ensuring" mode as the second setting, each of which designates execution of the refrigerant shortage sensing methods (1) to (9). In the first setting, among the plurality of refrigerant shortage sensing functions, the sensing methods (1) to (5) belonging to the first group are enabled and the sensing methods (6) to (9) not belonging to the first group are disabled. In the second setting, among the plurality of refrigerant shortage sensing functions, the sensing methods (6) to (9) belonging to the second group are enabled, and the sensing methods (1) to (5) not belonging to the second group are disabled. When the operation mode is set in the "energy-saving" mode as the first mode, the first setting is selected. When the operation mode is set in the "reliability ensuring" mode as the second mode, the second setting is selected.

Further, as shown in the flowchart in FIG. 7, controller 100A is configured to be capable of selecting a "normal" mode as the third setting and a "sensing disabled" mode as the fourth setting, each of which designates execution of the refrigerant shortage sensing methods (1) to (9). In the third setting, all of the plurality of refrigerant shortage sensing functions are enabled. In the fourth setting, all of the plurality of refrigerant shortage sensing functions are disabled.

Preferably, controller 100A may be configured to be capable of changing, in accordance with the input through input device 110, which one of the refrigerant shortage sensing methods (1) to (9) belongs to the first group classified as "energy saving" and which one of the refrigerant shortage sensing methods (1) to (9) belongs to the second group classified as "reliability ensuring".

Controller 100A shown in FIG. 4 includes: DIP switch 106 capable of setting whether to enable or disable each of the refrigerant shortage sensing methods (1) to (9) shown in FIG. 6; memory 104 in which an operation mode is stored; and CPU 102 as a processor that determines a refrigerant shortage sensing method to be enabled based on the operation mode stored in memory 104 and the setting by DIP switch 106.

The configuration as described above allows more detailed selection of a refrigerant shortage sensing method that is preferable for the user.

For at least one of the refrigerant shortage sensing methods (1) to (9), controller 100A is configured to be capable of changing a parameter used for sensing and to be capable of changing the amount of refrigerant to be sensed as a refrigerant shortage or changing the sensing sensitivity. For example, in the case of sensing according to the temperature efficiency of the heat exchanger by the sensing method (3), it is determined that a refrigerant shortage occurs when the temperature efficiency is kept below a reference value for a prescribed time period. In this case, when this prescribed time period is changed from 30 minutes to 24 hours, the sensing sensitivity can be significantly decreased. For example, also regarding the amount of liquid in liquid reservoir 30 in the case of the sensing method (1), the sensing level of the liquid level sensor is changed and thereby the sensing sensitivity can be changed. Further, in consideration also of variations during the operation, in the case where a refrigerant shortage is determined as having occurred when a sensing level is kept below the sensing level set in the sensing method (1) for a prescribed time period, then, this prescribed time period is increased, and thereby, the sensing sensitivity can be decreased similarly to the above.

As described above, when the user sets the operation mode so as to allow refrigeration apparatus 1A to achieve the performance desired by the user, refrigeration apparatus 1A presented in the second embodiment automatically enables the refrigerant shortage sensing method appropriate to the refrigerant amount suitable to achieve the performance desired by the user. Therefore, a refrigerant shortage warning not desired by the user can be avoided from being issued without the user's intention. In addition, DIP switch 106 is provided to thereby allow more detailed designation of a refrigerant shortage sensing method that meets the user's desire.

In the present embodiment, the operation mode is referred to as an "energy-saving" mode, a "reliability ensuring" mode and the like, but the name of the operation mode may be appropriately changed to an "eco mode" and the like.

The sensing methods (2) and (7) among the sensing methods described in the second embodiment correspond to the first sensing method and the second sensing method, respectively, in the first embodiment. Also in the configuration shown in the first embodiment, however, sensors may be added, the sensing methods (1), (3) to (5), (8), and (9) may be executable, and a DIP switch may be added to allow the user to individually set each of the modes to be enabled or disabled.

It should be understood that the embodiments disclosed herein are illustrative and non-restrictive in every respect. The scope of the present invention is defined by the terms of the claims, rather than the description of the above-mentioned embodiments, and is intended to include any modifications within the meaning and scope equivalent to the terms of the claims.

The invention claimed is:

1. A refrigeration apparatus that performs cooling using refrigerant, the refrigeration apparatus comprising:

a refrigerant circuit through which the refrigerant circulates;

a controller configured to execute refrigerant shortage sensing functions of sensing a shortage of an amount of the refrigerant; and an input device through which an operation mode to be set is input into the controller, wherein the controller is further configured to set the operation mode, responsive to the input from the input device, to one of a first mode which is predetermined as having an emphasis placed on energy-saving performance, and a second mode which is predetermined as ensuring reliability, in response to the operation mode being the first mode, sense a refrigerant shortage responsive to the amount of the refrigerant decreasing below a pre-set determination value that corresponds to a refrigerant shortage for efficient operation, and in response to the operation mode being the second mode, perform refrigerant shortage sensing only after the amount of the refrigerant decreases below the determination value and at least one of (a) falls within a predetermined range corresponding to an uncooled state of the refrigerant apparatus and (b) falls outside a predetermined range corresponding to reliability of the refrigeration apparatus being ensured.

2. The refrigeration apparatus according to claim 1, wherein the controller is further configured to in accordance with the operation mode set through the input device, determine which of sensing results obtained by the refrigerant shortage sensing functions corresponds to refrigerant shortage sensing functions set as enabled and which of the sensing results is correspond to refrigerant shortage sensing functions set as disabled, and in response to a sensing result determined to correspond to the refrigerant shortage sensing functions set as enabled showing a refrigerant shortage, give a notification about the refrigerant shortage.

3. The refrigeration apparatus according to claim 1, wherein the refrigerant shortage sensing functions are classified into a first group and a second group, the controller is further configured to select at least a first setting and a second setting that each designate execution of the refrigerant shortage sensing functions, in the first setting, among the refrigerant shortage sensing functions, a sensing function belonging to the first group is enabled and a sensing function not belonging to the first group is disabled, in the second setting, among the refrigerant shortage sensing functions, a sensing function belonging to the second group is enabled, and a sensing function not belonging to the second group is disabled, select the first setting responsive to the operation mode being set in the first mode, and select the second setting responsive to the operation mode being set in the second mode.

4. The refrigeration apparatus according to claim 3, wherein the controller is further configured to further select a third setting and a fourth setting that each designate execution of the refrigerant shortage sensing functions, in the third setting, all of the refrigerant shortage sensing functions are enabled, and in the fourth setting, all of the refrigerant shortage sensing functions are disabled.

5. The refrigeration apparatus according to claim 3, wherein the controller is further configured to, in accordance with an input through the input device, change which one of the refrigerant shortage sensing functions belongs to the first group and which one of the refrigerant shortage sensing functions belongs to the second group.

6. The refrigeration apparatus according to claim 1, wherein the controller includes a switch configured to set whether each of the refrigerant shortage sensing functions is enabled or disabled, a memory in which the operation mode is stored, and a processor configured to determine a refrigerant shortage sensing function that is enabled, based on the operation mode stored in the memory and a setting by the switch.

7. The refrigeration apparatus according to claim 1, wherein the controller is further configured to, for at least one of the refrigerant shortage sensing functions, change a parameter used for sensing and change the amount of the refrigerant to be sensed as a refrigerant shortage.

8. The refrigeration apparatus according to claim 1, wherein the refrigerant shortage sensing functions are classified into a first group and a second group, and further configured to, in response to a refrigerant shortage being sensed by a refrigerant shortage sensing function belonging to the second group, give a notification about the refrigerant shortage by a notification method different from a notification method used in a case where a refrigerant shortage is sensed by a refrigerant shortage sensing function belonging to the first group.

* * * * *